United States Patent [19]

Tomlinson et al.

[11] Patent Number: 4,821,465

[45] Date of Patent: Apr. 18, 1989

[54] ABRASIVE TOOL

[76] Inventors: Peter N. Tomlinson, 315 Enford Road, Mondeoe, Johannesburg, Transvaal; Richard P. Burnand, 39 Constantia Avenue, Alan Manor, Johannesburg, Transvaal; Klaus Tank, 9 Warbleton Road, Essexwold, Johannesburg, Transvaal, all of South Africa

[21] Appl. No.: 874,501

[22] Filed: Jun. 16, 1986

[30] Foreign Application Priority Data

Jun. 18, 1985 [ZA] South Africa ..... 85/4589

[51] Int. Cl.[4] ..... B24B 1/00

[52] U.S. Cl. ..... 51/283 R; 51/209 R

[58] Field of Search ..... 51/283 R, 206 R, 206 NF, 51/209 R, 307, 309

[56] References Cited

U.S. PATENT DOCUMENTS

| | | | |
|---|---|---|---|
| 2,194,546 | 3/1940 | Goddu | 51/209 R |
| 2,811,960 | 11/1957 | Fessel | 125/15 |
| 3,239,321 | 3/1966 | Blainey et al. | 51/309 |
| 3,912,500 | 10/1975 | Vereschagin et al. | 51/309 |
| 3,944,398 | 3/1976 | Bell | 51/307 |
| 3,982,911 | 9/1976 | Lee et al. | 51/307 |
| 3,999,962 | 12/1976 | Drui et al. | 51/307 |
| 4,124,401 | 11/1978 | Lee et al. | 106/44 |
| 4,151,686 | 5/1979 | Lee et al. | 51/307 |
| 4,231,195 | 11/1980 | DeVries et al. | 51/307 |
| 4,242,106 | 12/1980 | Morelock | 51/307 |
| 4,457,765 | 7/1984 | Wilson | 51/209 R |
| 4,534,773 | 8/1985 | Phaal et al. | 51/293 |

FOREIGN PATENT DOCUMENTS

| | | |
|---|---|---|
| 2238387 | 3/1974 | Fed. Rep. of Germany . |
| 997352 | 7/1965 | United Kingdom . |
| 2006731 | 5/1979 | United Kingdom . |
| 2006732 | 5/1979 | United Kingdom . |
| 2158086 | 6/1985 | United Kingdom . |

OTHER PUBLICATIONS

Bullen, G. J., "The Effect of Temperature and Matrix on the Strength of Synthetic Diamond", *Industrial Diamond Review,* Oct. 1975, pp. 363–365.

*Primary Examiner*—Frederick R. Schmidt
*Assistant Examiner*—Robert A. Rose
*Attorney, Agent, or Firm*—Curtis, Morris & Safford

[57] ABSTRACT

Thermally stable abrasive compacts of hexagonal shape have been found to have excellent abrasive properties in the abrading of a medium to soft rock having an unconfined compressive strength of less than 240 MPa. Preferably the abrasive tool used is a surface set drill bit wherein some of the thermally stable abrasive compacts are so located around the working edge of the bit that a side thereof acts as a gauge stone for the working portion.

3 Claims, 3 Drawing Sheets

ABRASIVE TOOL

BACKGROUND OF THE INVENTION

This invention relates to abrasive tools.

The complete specification of United Kingdom Patent Publication No. 2158086 discloses an abrasive tool having a working portion which includes an abrasive insert held therein, that insert being exposed to high temperature during manufacture or use of the tool and comprising a mass of diamond particles present in an amount of 80 to 90 percent by volume of the insert and a second phase present in an amount of 10 to 20 percent by volume of the insert, the mass of diamond particles containing substantial diamond-to-diamond bonding to form a coherent skeletal mass and a second phase consisting essentially of silicon, the silicon being in the form of silicon and/or silicon carbide. Examples of such tools are dressing tools, turning tools and surface set or impregnated drill bits.

It is stated in the complete specification of this application that the abrasive inserts may take on a variety of shapes depending on the use to which they are put. Examples of suitable shapes are said to be disc, triangular, cube, rectangular and hexagonal. The illustrated embodiments utilise abrasive inserts which are of triangular and cube shape.

The abrasive inserts are useful in the applications referred to above because they are thermally stable and have considerable strength. Examples of other thermally stable abrasive bodies are those described in U.S. Pat. No. 4,224,380 and the complete specification of South African Pat. No. 84/0053.

SUMMARY OF THE INVENTION

It has now been found that thermally stable abrasive compacts of hexagonal shape produce surprisingly good results in a variety of applications.

Thus, according to one aspect of the invention, there is provided a method of abrading a medium to soft rock having an unconfined compressive strength of less than 240 MPa, including the step of contacting a surface of the rock in an abrading manner with the working portion of an abrasive tool having a plurality of hexagonal shaped thermally stable abrasive compacts mounted in the working portion, each abrasive compact presenting a cutting edge or point for the tool. The abrasive tool is typically a surface set drill bit.

According to another aspect of the invention, there is provided a surface set comprising a working portion which includes a plurality of hexagonal shaped thermally stable abrasive compacts held therein, each abrasive compact presenting a cutting edge or point for the bit and some of the compacts being so located around the edge of the working portion that a side thereof acts as a gauge stone for the working portion.

DETAILED DESCRIPTION OF THE INVENTION

The hexagonal shaped abrasive compacts utilised in the invention must have thermal stability, i.e. they should be capable of withstanding a temperature of 1200° C. under a vacuum of $10^{-4}$ Torr or better or in an inert or reducing atmosphere without significant graphitisation of the diamond occurring, and they should have a substantial amount of diamond-to-diamond bonding. The preferred abrasive compact which satisfies these characteristics is that described in United Kingdom Patent Publication No. 2158086. These abrasive compacts comprise a mass of diamond particles present in an amount of 80 to 90 percent by volume of the compact and a second phase present in an amount of 10 to 20 percent by volume of the compact, the mass of diamond particles containing substantial diamond-to-diamond bonding to form a coherent, skeletal mass and the second phase consisting essentially of silicon, the silicon being in the form of silicon and/or silicon carbide.

The hexagons will generally be cut from disc shaped abrasive bodies produced using conventional high temperature/high pressure technology. The hexagonal shape is cost effective as a large number of such bodies may be cut from a single disc with little wastage.

Figure 1:
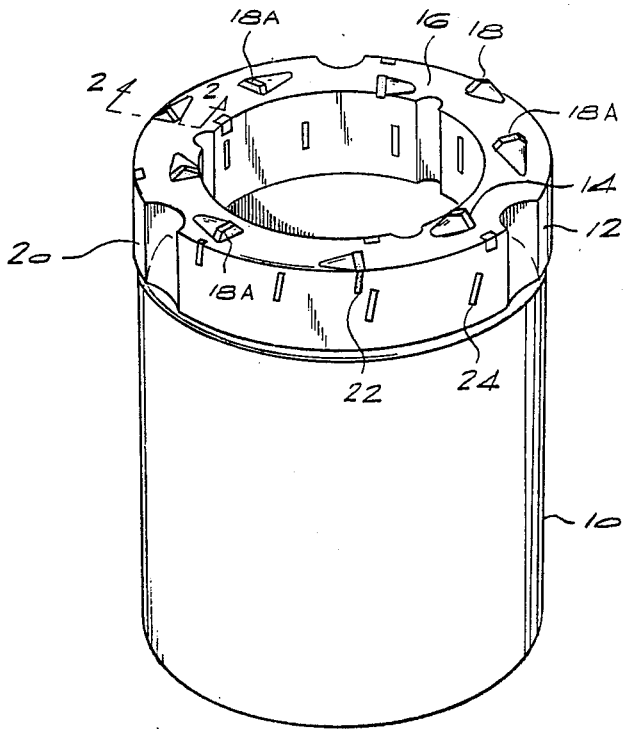
FIG. 1 illustrates a perspective view of a surface set drill bit of the invention.
Figure 2:
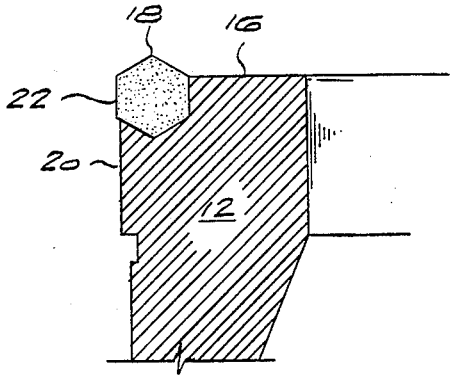
FIG. 2 is a section along the lines 2—2 of FIG. 1, po

An embodiment of the invention will now be described with reference to the accompanying drawings. Referring to FIG. 1, there is shown a surface set drill bit comprising a rotatable core 10 having at one end thereof a working portion 12. The working portion 12 comprises a plurality of cutting elements or abrasive inserts 14 firmly held in a suitable metal matrix. Each cutting element 14 has a hexagonal shape. The hexagon is substantially embedded in the metal matrix with a triangular shaped portion or elongate edge projecting above the top face 16 of the working portion. In use, it is the point 18 of the element or the elongate edge 18A of the element which is the cutting edge. The elements are so mounted and arranged around the cutting face that some of them are located at the edge face 20 of the working portion. As can be seen particularly from FIG. 2, the hexagon is so mounted in the working portion that a flat edge 22 thereof projects beyond the edge face 20 of the working portion and in so doing acts as a gauge stone for the bit. Additional gauge stones 24 of conventional configuration are also provided in the working portion.

In the illustrated bit, when the hexagons are mounted in the working portion such that each presents a cutting point 18, the arrangement has been found to be particularly suitable for the cutting of medium to hard rocks such as limestone and certain granites. Where medium to soft rocks having an unconfined compressive strength of less than 240 MPa such as many sandstones are to be drilled some of the inserts, particularly those which are not located at the edge face 20, will be so mounted that they present an elongate cutting edge 18A of the hexagon as illustrated by FIG. 1.

Figure 3A:
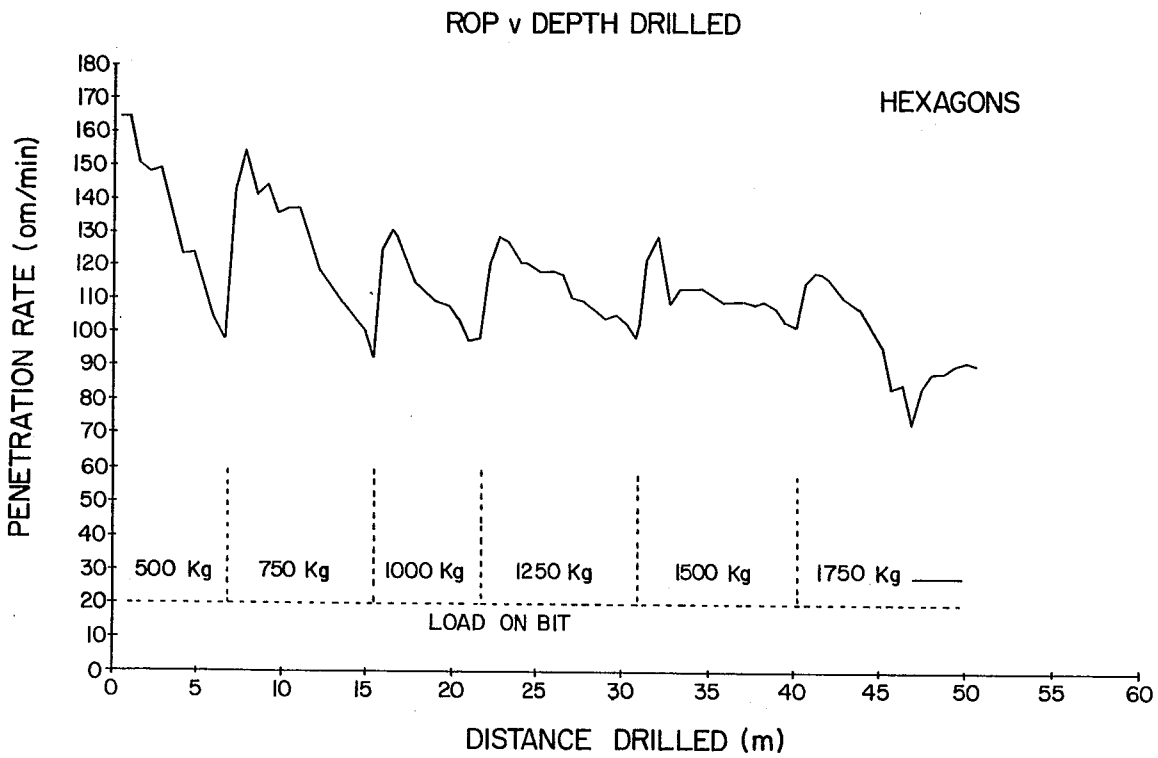
FIG. 3A and 3B illustrate graphically the results obtained in a comparative test.

A drill bit as illustrated by FIG. 1 was produced using diamond abrasive compact hexagons having a second phase consisting essentially of silicon, the silicon being in the form of silicon and/or silicon carbide, as described in British Patent Publication No. 2158086. This drill bit was tested in the drilling of pennant sandstone with an unconfined compressive strength of 220 MPa. Holes were drilled in the sandstone and the rate of penetration of the bit in relation to the depth drilled was measured at an increasing applied load. The speed of rotation of the bit was 1000 rpm. The results obtained are illustrated in the graph which forms FIG. 3A. It will be noted from this graph that an excellent penetration rate was achieved even after a depth of more than 50 meters had been drilled.

Figure 3B:
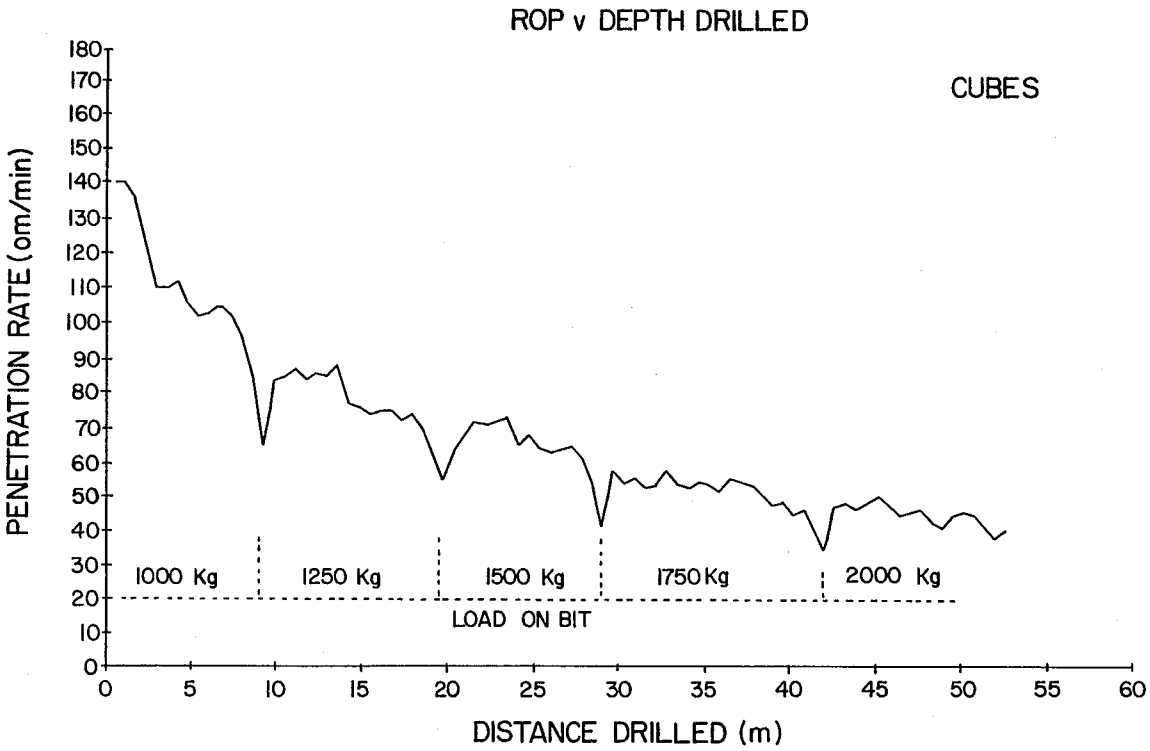

A drill bit as illustrated by FIG. 4 of British Patent Publication No. 2158086 was produced and subjected to the same test and the results thereof illustrated in the graph which forms FIG. 3B. It will be noted that a very much poorer penetration rate was obtained.

We claim:

1. A method of abrading a medium to soft rock having an unconfined compressive strength of less than 240 MPa, including the step of contacting a surface of the rock in an abrading manner with a working portion of an abrasive tool having a plurality of hexagonal shaped thermally stable abrasive compacts mounted in the working portion, wherein some of said hexagonal compacts are located around at least one circumferenial edge face of the working portion and are oriented such that an exposed flat edge of each of these compacts acts as a gauge stone for the working portion of said tool, the remaining hexagonal compacts each being located remote from said at least one edge face, said remaining hexagonal compacts being oriented such that each presents an exposed elongate cutting edge between points of the hexagon.

2. A method according to claim 1 wherein each of the thermally stable abrasive compacts comprises a mass of diamond particles present in an amount of 80 to 90 percent by volume of the compact and a second phase present in an amount of 10 to 20 percent by volume of the compact, the mass of diamond particles containing substantial diamond-to-diamond bonding to form a coherent, skeletal mass and the second phase consisting essentially of silicon, the silicon being in the form of silicon, silicon carbide or a combination thereof.

3. A method according to claim 1 wherein the abrasive tool is a surface set drill bit.

* * * * *